United States Patent [19]

Bailey, deceased

[11] 4,147,360

[45] * Apr. 3, 1979

[54] FOURSIDED CHESS GAME

[76] Inventor: Kenneth M. Bailey, deceased, late of Pointe Coupee Parish, La.; by Alyce B. Raymond, heir, 10607 Kathleen Ave., Huntley, Ill. 60142; by Bruce K. Bailey, heir, P.O. Box 5315, c/o Aramco, Dhahran, Saudi Arabia; by Kay E. B. McElreath, heir, 2048 Laurel Ave., Gretna, La. 70053; by Marsha L. B. Wood, heir, 652 West Niagra Cir., Gretna, La. 70053

[ * ] Notice: The portion of the term of this patent subsequent to Apr. 3, 1994, has been disclaimed.

[21] Appl. No.: 481,777

[22] Filed: Jun. 21, 1974

[51] Int. Cl.[2] ..... A63F 3/02

[52] U.S. Cl. ..... 273/261; 273/288

[58] Field of Search ..... 273/261, 260, 242, 258, 273/262

[56] References Cited

U.S. PATENT DOCUMENTS

| | | | |
|---|---|---|---|
| 511,306 | 12/1893 | Moore | 273/261 |
| 511,773 | 1/1894 | Higgins | 273/261 |
| 1,134,922 | 4/1915 | Smith | 273/261 |
| 1,141,909 | 6/1915 | D'Autremont | 273/260 |
| 1,474,504 | 11/1923 | Allen | 273/260 |
| 2,379,465 | 7/1945 | Vollmer | 273/260 |
| 3,341,205 | 9/1967 | Dykes | 273/261 |
| 3,532,342 | 10/1970 | Simpson et al. | 273/260 |
| 3,642,286 | 2/1972 | Moore | 273/260 |
| 3,843,130 | 10/1974 | Whitney, Jr. | 273/261 |

FOREIGN PATENT DOCUMENTS

| | | | |
|---|---|---|---|
| 386445 | 1/1923 | Fed. Rep. of Germany | 273/260 |
| 18266 of | 1895 | United Kingdom | 273/260 |
| 616572 | 1/1949 | United Kingdom | 273/261 |

*Primary Examiner*—Richard C. Pinkham
*Assistant Examiner*—Harry G. Strappello
*Attorney, Agent, or Firm*—C. Emmett Pugh & Associates

[57] ABSTRACT

A new chess game device and method for playing, for example, modified chess for four players. The novel chess game device includes a playing board of 260 squares using a set of twenty playing pieces consisting of 10 pawns and 10 other pieces per player for two, three or four players. Each set of playing pieces is colored in a distinct, separate color so that a different color is used to identify the playing pieces of each participant. The playing board is colored in the same four colors as the playing pieces in an alternating color fashion (FIG. 1). The set of playing pieces of the novel chess game device includes all of the conventional chess pieces and two additional pieces called the Prime Minister (FIG. 2) and the Squire (FIG. 3) respectively. The Prime Minister's sphere of movement is the same as a conventional Queen except the Prime Minister may also move a single square at a right angle in either direction to its chosen course either before it starts movement on its chosen course or after it completes all movement on its chosen course (FIG. 5). The Squire's sphere of movement is the same as a conventional Queen except it is limited to a movement of two squares in any direction that a conventional Queen can move (FIG. 7). The method of playing the new game of chess is to use normal chess rules except as modified to utilize the larger board, the extra players, and an accelerated game to permit use by four people.

5 Claims, 7 Drawing Figures

FOURSIDED CHESS GAME

BACKGROUND OF THE INVENTION

The present invention relates to a new chess game device and method for playing, for example, modified chess for four players. The present invention has been found to be particularly useful in the chess gaming art, especially as a device for multiple player participation such as three or four players, and hence will be discussed with particular reference thereto. However, the present invention permits the play by two players as well.

In the playing of any type of chess game, a set of playing pieces is allocated to each player. The players are located on a board of some shape upon which they move to accomplish the purpose of the chess game. The purpose of the chess game and the method of moving the players upon the board are prescribed by the rules of the chess game which forms the final component of the game.

Several types of chess game devices have been known and used before in the prior art. The game of chess itself, of course, is centuries old. Boards of various shapes have been known and used in the prior art. Typical examples thereof in the gaming art are four-sided gaming boards to accommodate multiple players, up to four. Note for example, U.S. Pat. Nos. 386,007 (Gibford, issued July 10, 1888); 1,555,937 (Billman, issued Mar. 21, 1925); 2,045,339 (Boland, issued June 23, 1936); 694,509 (Winckfield, issued Mar. 4, 1902); 1,679,652 (Dalrymple; issued Aug. 7, 1928); 2,379,465 (Vollmer, issued July 3, 1945); 1,114,717 (Au Buchon, issued Oct. 27, 1914); 701,414 (Standidge, issued June 3, 1902); and 1,674,533 (Templeton, issued June 19, 1928). However, these patents relate solely to checkers and modified boards accompanying them to permit multiple player participation and do not inter alia disclose multiple, orderly color on the board.

Additionally, several types of modified chess games have been known and used before in the prior art for two players. The prior art of this type discloses two varieties of games. One of these types uses an enlarged board and additional or changed chess pieces, such as for example a player that combines a movement of a conventional Queen and a Knight. Note for example, U.S. Pat. Nos. 1,141,909 (D'Autremont, issued June 1, 1915); 2,097,052 (Strey, issued Oct. 26, 1937); 1,780,038 (Parker, issued Oct. 28, 1930); 1,772,583 (Barrett, issued Aug. 12, 1930). The other type of two person chess game uses multiple level boards or three dimensional boards. Note for example, U.S. Pat. Nos. 1,877,154 (Weaver, issued Sept. 13, 1932); 3,464,701 (Mahoney, issued Sept. 2, 1969); 2,652,255 (Rutz, issued Sept. 15, 1953); 3,359,003 (Kass, issued Dec. 19, 1967); and 3,399,895 (Beach, issued Sept. 3, 1968). However, these patents relate solely to the two player participation without a crossed center or multiple, orderly color on the board.

The broad concept of a four sided chess game is also known in the prior art. For example, two types of multi-sided chess games, devices known in the prior art that involve multiple player participation are described below. The first type uses an hexagonal board and employs players in various positions upon the board. Players are to be marked in multiple colors and some of the prior art gaming devices such as combinations of Bishops and Knights or Knights and Rooks. Note for example, U.S. Pat. Nos. 3,341,205 (Dykes, issued Sept. 12, 1967); and 1,704,819 (Beaman, issued Mar. 12, 1929). However, these patents relate solely to games where victory is decided by checkmate, where the shape of the board is not that of the present invention, and where other rules of the present invention are not utilized to permit full use of the entire board by all pieces and suitable to a game with multiple players. Also, the board is not multicolored in an orderly manner for recording purposes. The other type of multi-sided chess gaming device known in the prior art that involves multiple player participation uses a board configured in the shape of the Greek Cross which is a four sided board, square or rectangular in shape, with rectangular or square shaped extensions on all four sides and which extensions are equal in width and length on opposite sides of the board. Some of these use modified players or modified player names and one uses diagonals across the board where pawn movement changes. Note for example, U.S. Pat. Nos. 1,134,922 (Smith, issued Apr. 6, 1915); 511,306 (Moore, issued Dec. 19, 1893); 1,202,191 (King, issued Oct. 24, 1916); and 3,433,482 (Castellano, issued Mar. 18, 1969). However, these patents also relate solely to games where victory is decided by checkmate and where other rules of the present invention are not utilized to permit full use of the entire board in much the same way that conventional chess permits full use by all pieces and to permit more expiditious play more suitable to a game with multiple players. Also, the board is not multicolored in an orderly manner for recording purposes.

In contrast to the prior art, having the problem of maintaining as much as possible the orderly and familiar rules of chess as it has been known for centuries while permitting fast and expedient play by up to four people in an easily understood manner by those already familiar with the classical game of chess, the present invention utilizes a very simple but highly effective design of a modified chess board together with additional players and a few rule changes to adapt classical chess to a form compatible for play by up to four participants. The present invention utilizes a board in the form of a Greek Cross in which all four extensions have equal lengths and widths. Also, the board of this new chess game device is multi-colored unlike previous boards in the prior art with one color corresponding to each set of pieces of the four sets potentially capable of being used simultaneously on the board and which colors are arranged to permit uniform recording as in classical chess. Moreover, the board itself is extended so that its center playing region is ten squares by ten squares. Additionally, the central portion of the playing board of ten squares by ten squares is divided by two diagonal lines originating from the corners of the squares. This cross provides the playing surface for the color scheme of the board. Also, the cross serves as a guide line for the directions that Pawns move on the board. Additionally, the present invention employs two more Pawns and two new pieces with moves combining those of a Queen with certain lateral moves and limitations. Finally the game is accelerated by disqualifying a player and removing his pieces from the playing board when the player's King is put into check instead of check mate as required by classical chess.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Introduction

The chess game device of the present invention can be used for playing chess wherein it is important that more than two players participate at the same time or where additional pieces in the playing set are to be employed with modified rules to add diversity to the classical game of chess. A particularly important area of application of the present invention is in the participation of four players in the new chess game device of the present invention, and therefore the preferred embodiment of the present invention will be described with respect to such an application although the game of the present invention can be used by as few as two players.

Structure and Method of Use

Figure 1:
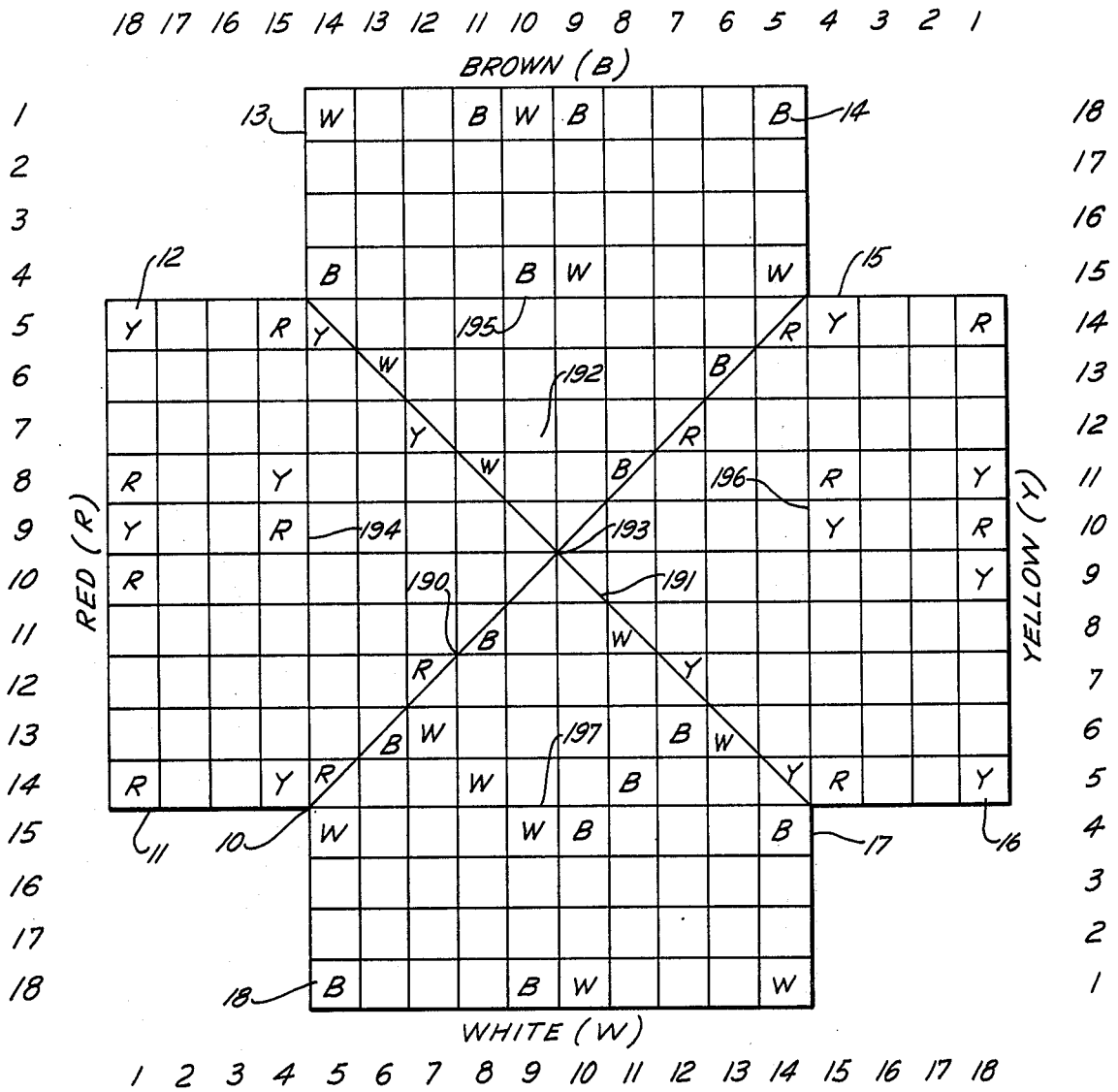
FIG. 1 is a top view of the board of the preferred embodiment of the chess game device of the present invention, showing the color arrangement, shape, and cross placement of the board of said chess game device.

Referring to FIG. 1, there is shown the structure and color scheme of the new chess game device of the present invention as it is used for the playing field for the movement of the playing pieces of the participating players. The center portion of the board 192 consists of a large square composed of one hundred small squares (ten by ten). Two diagonals 191 and 190 divide the central portion 192 of the playing board 10 into four equal parts which are isosceles triangles having four right angles at the intersection 193 of the two diagonals 190 and 191. On all four sides of this large square is placed a rectangle 11, 13, 15 and 17 of forty squares (ten wide by four deep), one side of which is coequal and shares the same lines 194, 195, 196, and 197 as does the hypotenuse of the triangle described above on which it abutts. There are then four identically shaped areas formed on the board, each area consisting of a triangle and rectangle described above. Each area is designated by color representing the set of playing pieces that is set on the area. Area 1 includes the rectangle 17 and is designated white, area 2 includes the rectangle 11 and is designated red, area 3 includes the rectangle 13 and is designated brown, and area 4 includes the rectangle 15 and is designated yellow. All of the small squares composing an area and the half squares that also are included in the area will be colored alternately. The areas designated as white and brown are colored alternately in white and brown. The areas designated red and yellow are colored alternately red and yellow. In FIG. 1, R represents red, Y represents yellow, B represents brown, and W represents white. The area designated as white is colored alternately in brown and white starting from the lower left hand small square 18 of rectangle 17; that square is colored brown. Obviously the border of half rectangles between the area designated as red and the area designated as white will be colored in brown in the area designated as white and red in the area designated as red. Similarly, the area designated as red will have yellow starting in its lower left hand rectangle 12 and its border of half rectangles between the area designated as red and the area designated as brown will be yellow on the side of the area designated as red and white on the side of the area designated as brown. This pattern is carried over into the area designated as brown where the left hand small square 14 is brown and the area designated as yellow where the left hand small square 16 is yellow.

The new chess game device of the present invention, and double cross chess, is played in a manner similar to classical chess. Classical chess players and rules have been modified and adapted, where necessary, to conform to this new chess game device. The change affects the board as described previously, the rules and also the number and types of pieces used to enable two, three, or four players to participate in a chess like game. The numbers 1 through 19 on the four sides of the board on FIG. 1 reflect the depth of the playing field in each direction. All players can use any 18th hostile row as the last row for converting pawns to other playing pieces. As indicated in FIG. 1, the board for the new chess game device has a white, small square on the right on the base line of the rectangle 17 for the area designated as white. This places the White Queen on her own color. Similarly, the area designated as red has a red small square for the farthest right square of the base line of the rectangle designated as 11 which also places a red Queen on a red small square. Opposite the white Queen on the 18th row, the brown Queen will be on a brown square and a brown square will be located on the base line of the rectangle denoted as 13 at the square 14. The yellow Queen will be opposite the red Queen and will be on her own color with a yellow square 16 at the extreme left of the rectangle 15 of the area designated as yellow.

For illustration of nomenclature designation, the square 199 will be the white King's Bishop 5 or the Brown King's Bishop 14 or the Red King's Rook 12 or the Yellow King's Rook 7. The board is designed so that uniform recording and reporting is possible in the same manner as classical chess.

Figure 2:
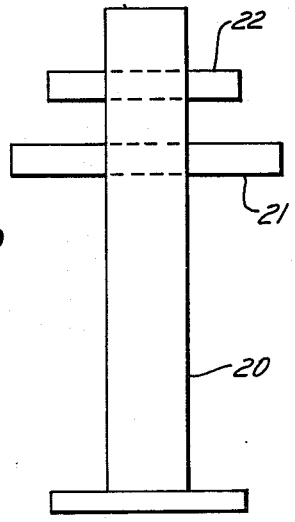
FIG. 2 is a frontal view of one of the additional playing pieces of the preferred embodiment of the chess game device of the present invention known as the Prime Minister.

FIG. 2 shows a drawing of the playing piece known as the Prime Minister (PM). The drawings of FIG. 2 is the shape of the playing piece of the preferred embodiment of the present invention. The figure is drawn to a 1 to 1 scale and with a base one and one quarter inches in diameter. This size would be used on a board of the design of FIG. 1 having small squares of a size of one and a half inches on a side. The piece may be made of wood, plastic, metal or a combination thereof or other suitable materials, and proportions and shape can be modified to suit the board and the designer. The shape shown in FIG. 2 portrays additionally, the meaning of the words "double cross" in the invention formed by the vertical member 20 which is the shape and horizontal members 21 and 22 of the playing piece.

Figure 3:
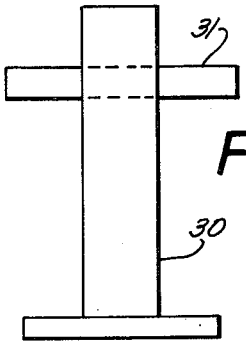
FIG. 3 is a frontal view of one of the additional playing pieces of the preferred embodiment of the chess game device of the present invention known as the Squire.

FIG. 3 shows a drawing of the piece known as the Squire (Sq). The shape of the figure shown in FIG. 3 is the shape to be used in the preferred embodiment of the present invention. The figure is drawn to a 1 to 1 scale and with a base of one and one quarter inches in diameter. This size would be used on a board of the design of FIG. 1 having small squares of a size of one and one half inches on a side. The pieces may be made of wood, plastic, metal or a combination thereof or other suitable material, and proportions and shape can be modified to suit the board and the designer. The shape shown in FIG. 2 portrays additionally, the meaning of the word "cross" in the invention which is the shape formed by the vertical member 30 and the horizontal member 31.

Figure 4:
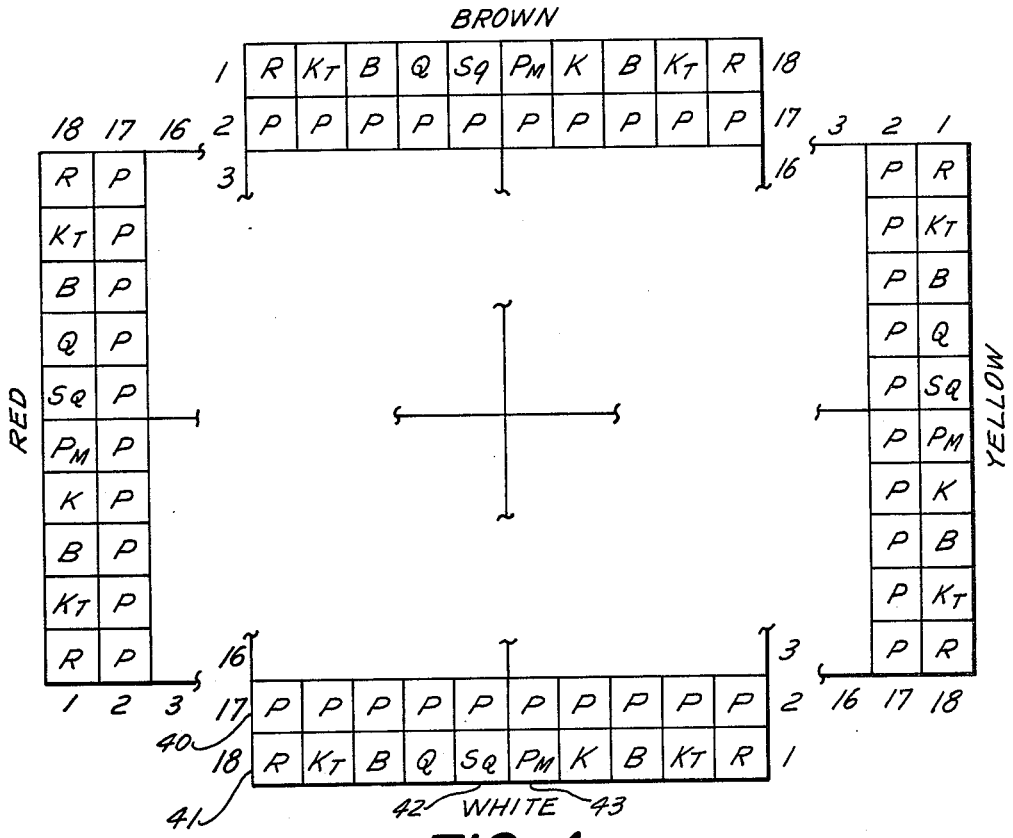
FIG. 4 is a top view of the board of the preferred embodiment of the chess game device of the present invention showing the playing pieces for all of the four possible sets at playing pieces of the preferred embodiment of the chess game device including the new playing pieces.

A maximum of four sets of the standard chess pieces and the additional chess pieces of FIG. 2 and FIG. 3, each using a different color conforming to that used on the board, may be used in playing the new chess game device of the present invention. The pieces are arranged on the chess board as shown in FIG. 4 with row 2 denoted as 40 in the drawing of each file made up of ten Pawns and row 1 denoted as 41 in the drawing of each file made up of the classic pieces of two Rooks, two Knights, two Bishops, one Queen and one King possessing the same moves attributed to them in the classic game of chess and two additional pieces, the Squire 42 and the Prime 43 Minister shown in FIGS. 2 and 3 whose ability to move will be discussed hereinafter. As previously discussed, the Queen will be placed on her own color. Next to the Queen, instead of the King which is positioned therein the classic game of chess, is the Squire. Next to the Squire is the Prime Minister and next to the Prime Minister is the King.

Figure 5:
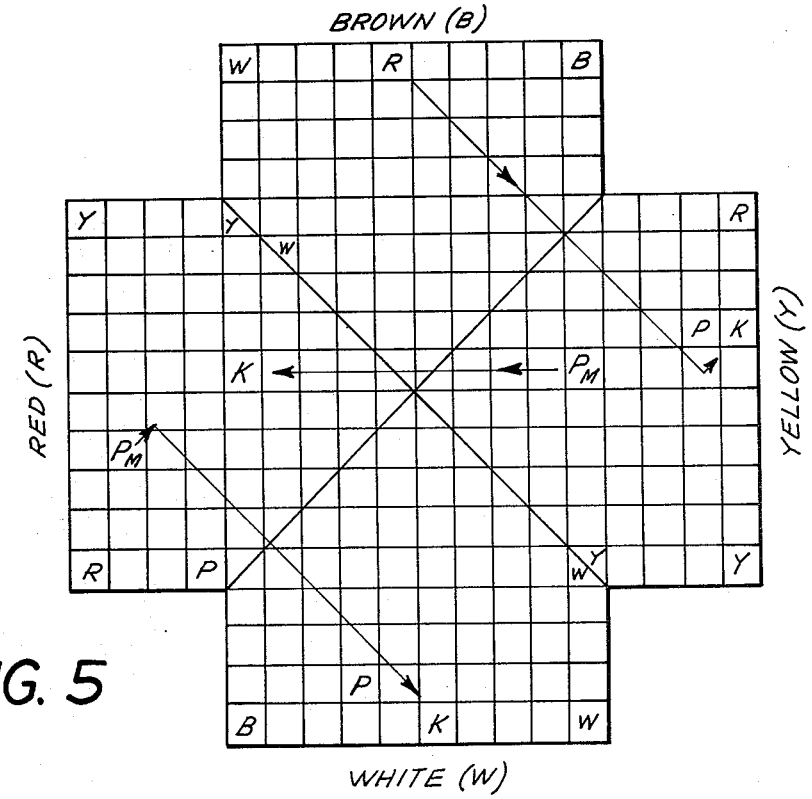
FIG. 5 is a top view of the board of the preferred embodiment of the chess game device of the present invention showing the methods that a Prime Minister can place an opposing King in check to disqualify an opposing player.
Figure 6:
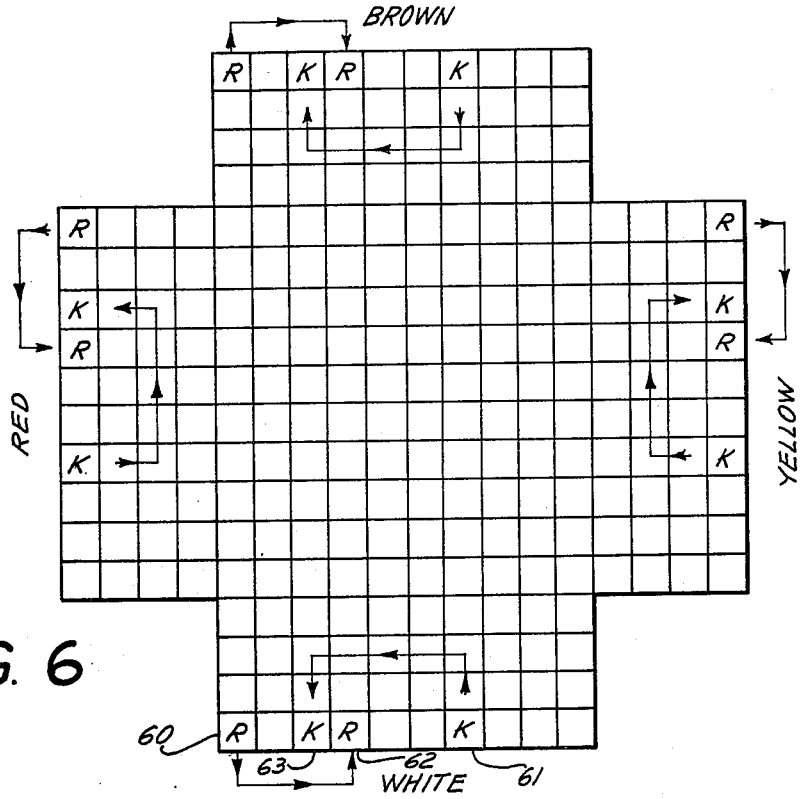
FIG. 6 is a top view of the board of the preferred embodiment of the chess game device of the present invention showing the modification of the rule for Queen side castling of the King and the Rook.

The Prime Minister may move from any position on the board where he is located in any direction as far as he wishes or until stopped by the presence of another player which, of course, if it is a player of an opposite color may be taken by the Prime Minister. Also, the Prime minister may move, if he has not taken another player, one additional square at right angles to the selected direction of travel. The ability of the Prime Minister to move as far as the Prime Minister wishes in any direction is illustrated by move 51 of FIG. 5. The ability of the Prime Minister to move as far as the Prime Minister wants in any direction and then move one square in a right angle to that direction is shown by move 52 in FIG. 5. The Prime Minister may also start by moving one square in any direction and then may go at right angles as far as the Prime Minister wishes to go or until the Prime Minister is stopped by encountering another player which the Prime Minister may capture, if it is a piece of an opponents's set of playing pieces. This movement is illustrated in move 50 in FIG. 5. Movements 50, 51 and 52 of the FIG. 5 show some of the various ways that the Prime Minister can place an opposing King in check. Because of the powerful moves of an opponent's Prime Minister, precautions must be taken to protect the King during the play of the game. Therefore Queen side castling is still permitted in the game, despite the larger separation of the King from the Queen side Rook. The King located at 61 in the white area is moved to location 63 and the Rook located at 60 is moved to 62 in the white area to complete castling. Obviously, to permit Queen side castling, no playing pieces may be in the squares between the King and the Rook when castling occurs, and neither the King nor the Rook may have moved prior to the castling taking place.

Figure 7:
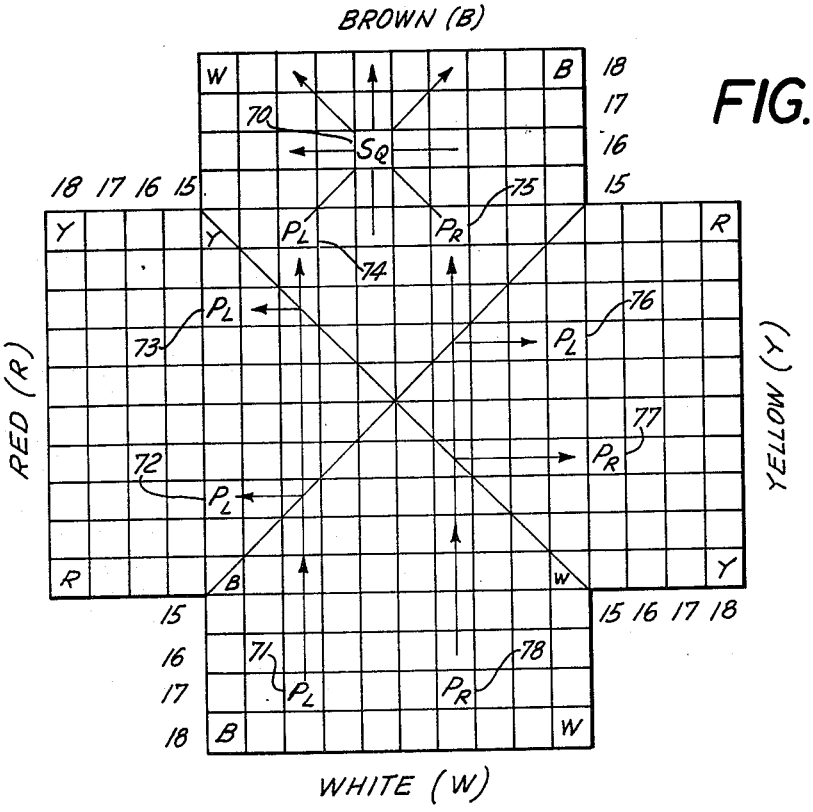
FIG. 7 is a top view of the preferred embodiment of the chess game device of the present invention showing the methods that the Squire can move and showing the variations of the movements of Pawns as they encroach upon the diagonals of the board.

Additionally, with the introduction of the Prime Minister with such powerful moves into the new chess game device, further precautions must be taken to protect the King. This is the duty of the Squire. The Squire's movements are shown in 70 of FIG. 7. The Squire is permitted to move either one or two squares in any direction, just as the Queen would move if the Queens movements were so limited to only two squares.

The rule of conversion of any side's Pawn to pieces of higher rank is still retained in this new chess game device with one exception. No Pawn may be converted to a Prime Minister. The only piece capable of being converted to a Prime Minister is a Squire. The Squire may become a Prime Minister only if the Prime Minister of the side that wishes to make the conversion has been captured and if the Squire can reach the eighteenth row of an opponent. This assures that no side will ever have two Prime Ministers. Additionally no Pawn can be exchanged for a Squire upon the attaining of any eighteenth row of an opponent by a Pawn. An eighteenth row of an opponent is defined as the last row of rectangular extension of the palying board where an opponent originates the moves of his pieces.

The entire board, of course, is a playing field upon commencement of the game for all playing pieces including Pawns. Pawn movements are more restricted than any other playing piece by the nature of the classic definition of a Pawn, but they also have some latitude that permits them to be sent to any part of the board. A Pawn starts in the usual way of moving either one or two moves from row two and continues until it reaches a diagonal 190 or 191. Upon reaching a diagonal, the Pawns on the left designated generally as 71 may turn left at right angles 72 or continue to the next diagonal 190 or 191 where they can turn left at right angles 73 or continue 74. Similarly the five Pawns on the right designated generally as 78 may turn right upon encountering diagonals 190 and 191 or continue straight as shown by 77, 76 and 75. If a Pawn, before reaching any diagonal, should capture another playing piece and therefore move into another file, the Pawn would continue to move as the original Pawn in that file would have moved. Also, the "en passant" for the position for the capturing Pawn would be the 15th row in the new chess game device as a result of the elongated board.

There is nothing in the rules that will prevent any side from combining with any other side to defeat others before completing the game between themselves.

If three play, it will be white, red and brown. For two players, just white and brown will be used.

The object of the game is to move and remove playing pieces in order to check the opponent's King. When a King is checked without jeopardy to the playing piece doing the checking, except by the movement of another playing piece that would subject the King to immediate capture or except if the King would be the only piece capable of taking the checking piece and in doing so would be subject to immediate capture by another opponent's playing piece, the player whose King was placed in check has all his playing pieces removed from the game. More than one side can attempt to check the same King. After the first King has been checked and the playing pieces removed, if three or four players are participating, the game continues until the next King has been checked, and his set of playing pieces is then removed. The two survivors, if four players are participating, then continue until one is a winner or a draw results. It should be noted that a draw or stalemate anytime during the play of the game terminates the game in a draw or stalemate for all players.

Because white starts moving first, when a game has been concluded, the board revolves to the left so that the red position becomes white with the privelege of first move.

In summary, then, in the present invention, the board 10 of FIG. 1 has placed upon it the playing pieces shown in FIG. 4 in the order shown in FIG. 4, including the two new pieces introduced in this new chess game device, the Prime Minister and the Squire. The game commences with the first move by white of its playing pieces followed in succession by red, brown and yellow. In the play of the game all chess rules of classical chess are followed except that ten Pawns are used, Pawns are capable of moving at right angles to their present direction upon reaching an intersection 190 or 191, there are two extra Pawns, "en passant" takes place in row 15, Queen side castling has a greater distance to go for the King and Rook to be interchanged, two new pieces the Prime Minister and Squire are introduced into the game with the moves as described previously, all of the playing pieces of a player are removed when a King is placed into check, Pawns may not be exchanged for Prime Ministers or Squires, Squires may be exchanged to gain a Prime Minister. Multiple players may participate and players may combine to eliminate another opponent.

Although the device described in detail supra has been found to be most satisfactory and preferred, many variations in its structure or use are, of course, possible. For example, the device of the present invention may be used for team play instead of two, three or four participants against each other. Also, the shape and size of the Prime Minister and Squire can be altered to suit the designer's wishes for those pieces. Moreover, the colors of the board may be altered as desired by the designer.

The above are, of course, merely exemplary of the many possible changes or variations.

Because many varying and different embodiments may be made within the scope of the inventive concept herein taught, and because many modifications may be made in the embodiments herein detailed in accordance with the descriptive requirements of the law, it is understood that the details herein are to be interpreted as illustrative and not in a limiting sense.

What is claimed as invention is:

1. A chess board device for chess type play among two to four players comprising:

(a) a board, having (1) a square central section being sub-divided into a plurality of smaller squares and having two diagonal lines thereon further subdividing said central section into four triangular central sub-sections, and (2) four wing sections, each being a rectangular section extending from one side of said cental section, contiguous therewith and forming with said associated triangular sub-section a complete board sub-section of said board, and being likewise subdivided into a plurality of squares the same size as said central section squares, said board having said squares alternately colored in four different colors, each board sub-section having said squares colored alternately. with but two of said four colors, opposite sub-sections having the same two colors for their squares, wherein said color scheme serves to identify and distinguish each of said squares and wherein said diagonals serve as reference indicators for perpendicular piece movement into adjacent sub-sections; and (b) a set of playing pieces for game play on said board comprising:

(1) the pieces of a conventional chess set for movement according to conventional chess rules, said playing pieces to be placed on the outermost two rows of squares of at least two of said wing sections in conventional chess arrangement.

2. The device of claim 1 further comprising:

(a) a first additional major piece having allowance for movement in the manner of a conventional chess Queen with the additional capability on any given move of a single one square step perpendicular to the conventional chess Queen movement;

(b) a second additional major piece with allowance for movement in the manner of a chess Queen, but limited to the traversal of two squares per move, said additional major pieces to be initially placed on the same row as the major pieces of said conventional chess set; and (c) two additional pawns to be initially placed on the same row as the pawns of said conventional chess set.

3. The device of claim 2 wherein:

(a) said first additional piece is initially placed between the King and Queen of said conventional chess set, next to said King; and (b) said second additional piece is initially placed between the King and Queen of said conventional chess set, next to said Queen.

4. The device of claim 1 wherein all of a player's pieces are removed from the board when the player's King is put into check.

5. The device of claim 1 wherein said central section is subdivided ten squares by ten squares and said wing sections are four rows deep.

* * * * *